US008956002B2

(12) United States Patent
Carr

(10) Patent No.: US 8,956,002 B2
(45) Date of Patent: Feb. 17, 2015

(54) ILLUMINATED PARKING BARRIER

(76) Inventor: Bernadette Carr, Deptford, NJ (US)

( * ) Notice: Subject to any disclaimer, the term of this patent is extended or adjusted under 35 U.S.C. 154(b) by 0 days.

(21) Appl. No.: 13/218,205

(22) Filed: Aug. 25, 2011

(65) Prior Publication Data

US 2012/0051036 A1 Mar. 1, 2012

Related U.S. Application Data

(60) Provisional application No. 61/402,262, filed on Aug. 26, 2010.

(51) Int. Cl.

| | |
|---|---|
| ***F21L 4/00*** | (2006.01) |
| ***E01F 9/053*** | (2006.01) |
| ***G09F 13/22*** | (2006.01) |
| ***G09F 19/22*** | (2006.01) |

(52) U.S. Cl.

CPC ..... *E01F 9/0536* (2013.01); *G09F 13/22* (2013.01); *G09F 19/22* (2013.01)

USPC ..... 362/190

(58) Field of Classification Search

USPC ..... 362/190; 404/7

See application file for complete search history.

(56) References Cited

U.S. PATENT DOCUMENTS

| | | | | |
|---|---|---|---|---|
| 2,920,184 | A * | 1/1960 | Kessler | 362/152 |
| 3,663,808 | A * | 5/1972 | Baatz | 362/152 |
| 4,945,675 | A * | 8/1990 | Kendrick | 47/33 |
| 4,999,749 | A | 3/1991 | Dormand | |
| 5,075,833 | A | 12/1991 | Dormand | |
| 5,772,357 | A * | 6/1998 | Evans | 404/7 |
| 5,951,144 | A | 9/1999 | Gavigan et al. | |
| 6,082,886 | A | 7/2000 | Stanford | |
| 6,286,978 | B1 | 9/2001 | Tait et al. | |
| 6,354,714 | B1 | 3/2002 | Rhodes | |
| 6,416,200 | B1 * | 7/2002 | George | 362/146 |
| 6,602,021 | B1 * | 8/2003 | Kim | 404/16 |
| 6,692,182 | B1 * | 2/2004 | Fenimore et al. | 404/7 |
| 6,739,735 | B2 | 5/2004 | Talamo et al. | |
| 2009/0046451 | A1 * | 2/2009 | Hoover | 362/183 |
| 2010/0052549 | A1 | 3/2010 | Hudson et al. | |
| 2010/0182797 | A1 * | 7/2010 | Wells | 362/474 |
| 2010/0320918 | A1 | 12/2010 | Hudson et al. | |

FOREIGN PATENT DOCUMENTS

| | | | |
|---|---|---|---|
| GB | 1 492 397 | | 11/1977 |
| GB | 2 403 499 | A | 1/2005 |
| JP | 2005-220618 | A | 8/2005 |
| KR | 443453 | Y1 | 2/2009 |
| KR | 997618 | B1 | 12/2010 |
| KR | 1037196 | B1 | 5/2011 |
| KR | 2011-085169 | A | 7/2011 |

* cited by examiner

*Primary Examiner* — Evan Dzierzynski
(74) *Attorney, Agent, or Firm* — Flaster/Greenberg, P.C.

(57) ABSTRACT

An illuminated curb barrier is disclosed which includes a curb barrier body; and a lighting source situated on the curb barrier body. The lighting source can be a solar source, which includes at least one solar photoresister panel situated on an upper surface of the housing, a battery, a controller board, and an LED light source.

13 Claims, 3 Drawing Sheets

ILLUMINATED PARKING BARRIER

CROSS-REFERENCE TO RELATED APPLICATIONS

This application claims the benefit under 35 U.S.C. §119(e) of U.S. Provisional Application No. 61/402,262, filed Aug. 26, 2010, the entire disclosure of which is hereby incorporated by reference.

BACKGROUND OF THE INVENTION

1. Field of the Invention

This invention relates generally to an illuminated parking barrier and, more particularly, the invention relates to an illuminated parking barrier for making such barriers more visible to avoid accidents and injury.

2. Description of Related Art

There are problems associated with parking and passing through parking lots at night, particularly when such lots are not well lit. Most parking lots are divided by a series of painted grid lines to afford individual spaces for cars, trucks and other vehicles. In addition, at the head of each parking space is a elongated raised concrete slab or partial curb that provides a barrier for preventing two facing vehicles from parking too close to one another; or from preventing a vehicle in a parking space generally from pulling into the spot too far and inadvertently hitting a further curb for a sidewalk for pedestrians, a building having parking spaces in from thereof or from otherwise damaging another structure, or from driving off a slope, edge or hill.

While such curb barriers are indeed important in parking lots are areas, they can present hazards particularly at night or when not readily visible. Such curb barriers can be a tripping hazard for pedestrians leading to falling and injury, abrasions or the like. Dangerous falls can result with associated injuries such as sprained ankles, broken arms, or cuts requiring stitches. For other drivers, if the curb barrier is not readily discernible, for example in the dark, the driver can drive his or her car up onto or over a curb barrier causing damage to the car as well. For property owners maintaining such curb barriers, even if required by the parking structure, such injuries to people and vehicles cause pain and suffering, and personal property damage which can lead to lawsuits, and costs associated with settlements and insurance claims.

Possible solutions to such problems include additional parking lot lighting, and phosphorescent paints which catch light from car headlights. While additional lighting is helpful, it is not financially practical in all parking lots and areas, and does not always make such curb barriers sufficiently distinct to avoid all injury and damage. Phosphorescent paint is also helpful for vehicles having headlights, provided the driver catches a view of the paint in the headlights, but not all drivers do see such barriers and such paint which requires illumination by lights at night to phosphoresce does not assist pedestrians walking in the dark.

There have been attempts to provide lighted posts for bollards and parking posts, including incorporating LED lighting or signals in such posts for use in lighting walkways, in front of buildings, pedestrian crossings, loading docks and the like. See for example, Korean Patent Publication No. 2011-085169 A (lighted pedestrian crossing bollard), U.S. Patent Publication No. 2010/0320918 A1 (lighted bollard for loading dock), U.K. Patent Application GB 2 403 499 A (solar powered lighting bollard for lighting walkways, streets, parks, buildings, parking lots and remote areas) and U.S. Pat. No. 5,075,833 (vandal proof louvered bollard for lighting waterfront docks and walkways). However, such bollards stand upright and require special installation. Further, they have limited areas of lighting and so in a larger parking area if such bollards are not placed throughout a parking lot, many curb barriers can remain unlit and hard to detect by pedestrians.

Accordingly, there is a need in the art for a method of providing a curb barrier in a parking lot that is more readily discernible to drivers and pedestrians, which is cost effective for parking lot and property owners to install, preferably without the need to replace all such barriers at high cost to the parking lot or property owner.

BRIEF SUMMARY OF THE INVENTION

The invention includes an illuminated curb barrier, comprising: a curb barrier body; and a lighting source configured to be situated over an upper surface the curb barrier body so as to provide lighting along at least a peripheral area of the curb barrier body.

The curb barrier body preferably has at least one upper surface and the lighting source is further situated so as to provide light through the upper surface of the curb barrier body. The illuminated lighting source may further comprise a housing mounted to the curb barrier body. The housing is preferably mounted to the curb barrier using at least one screw.

The lighting source preferably also comprises a power source, which may be a solar source. The solar source may comprise at least one solar photoresister panel situated on the housing, a battery in electrical communication with the panel, a controller board, and an LED light source. The battery is preferably a nickel cadmium battery.

Such a curb barrier may also further comprise situating a diode of the LED between a battery and the at least one solar cell. About four to about six photoresister solar cells/panels may be used. The power source may also comprise an electrical power source.

An illuminated housing for use on a curb barrier is also included in the invention, comprising a power source and lighting source, wherein the lighting source is situated within the housing and the housing is configured for placement on an upper surface of a curb barrier.

The power source is preferably a solar source, and the solar source may comprise at least one solar photoresister panel situated on an upper surface of the housing, a battery, a controller board, and an LED light source.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
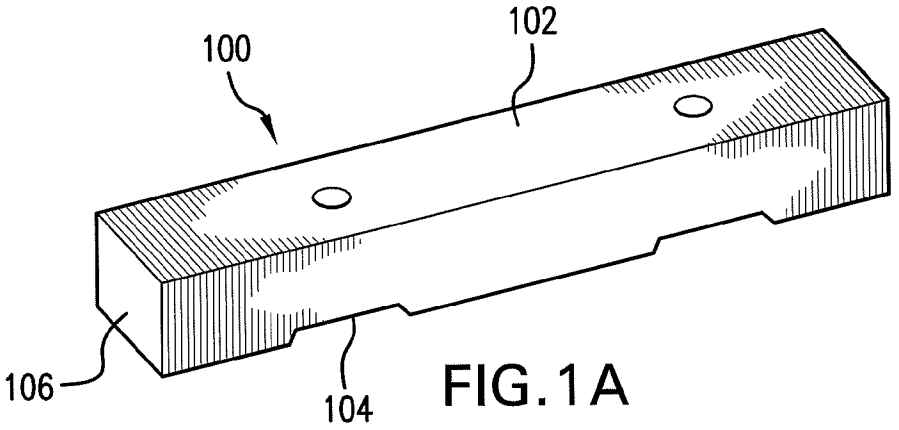
FIGS. 1A and 1B are perspective views of typical parking curb barriers having a generally rectangular side and a bent irregular polygonal side respectively.

As used herein, the terms "upper" and "lower," "left" and "right," "outward" and "inward," and the like are used to better explain the preferred embodiment herein and refer to directions in the drawings to aid in understanding the invention. Such terms are meant to have their ordinary meaning as used herein and are not meant to be limiting.

Figure 1B:
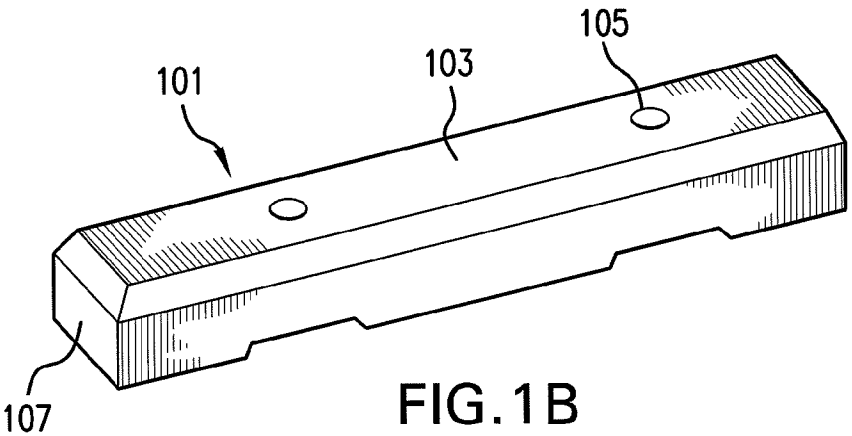
FIG. 1B PRIOR ART

As shown in FIGS. 1A and 1B curb barriers come in various shapes but are generally elongate slabs formed of concrete or similar material. They can have somewhat varied profile. FIG. 1A shows a standard curb barrier 100 having gaps 104 formed by grooves in the bottom of the barrier 100. such gaps 104 are reasonably standard and accommodate fluid flow from rainwater as well as a fixation bolt(s) through holes 105 (see FIG. 1B) extending through the barriers. Such bolts are not always used or on place, but can be used to fasten the barriers in a fixed manner to a surface. The upper surface of the curb barriers can be generally rectangular as shown in FIG. 1A with respect to the upper surface 102 of curb barrier 100 and having a generally square or rectangular side surface 106. Alternatively, the curb barriers can be more of a generally rectangular upper surface with a sloped edge configuration as shown for upper surface 103 of curb barrier 101 in FIG. 1B.

Figure 2:
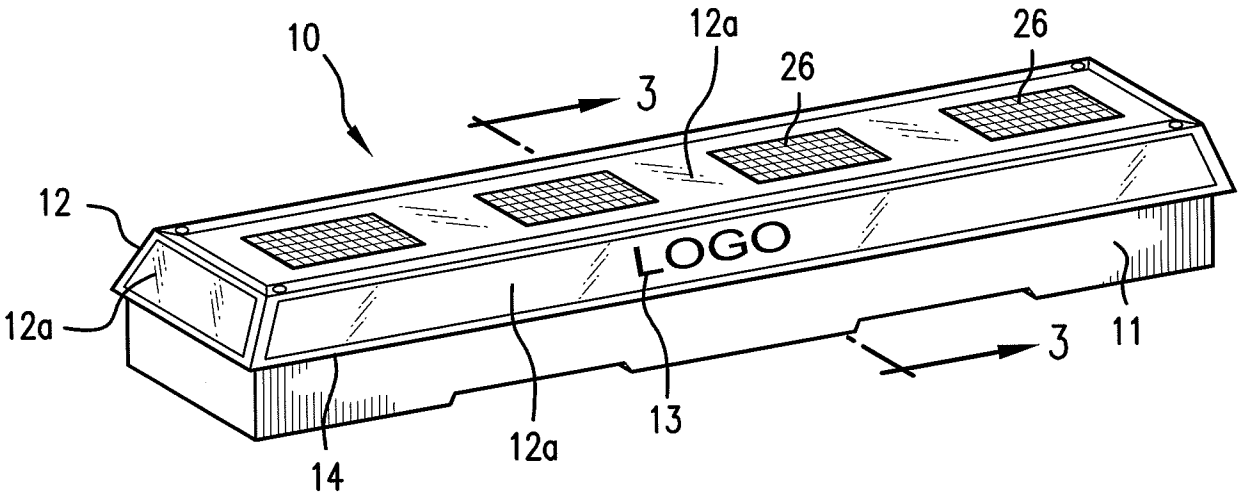
FIG. 2 is an example of one preferred embodiment of a curb barrier according to the present invention.
Figure 3:
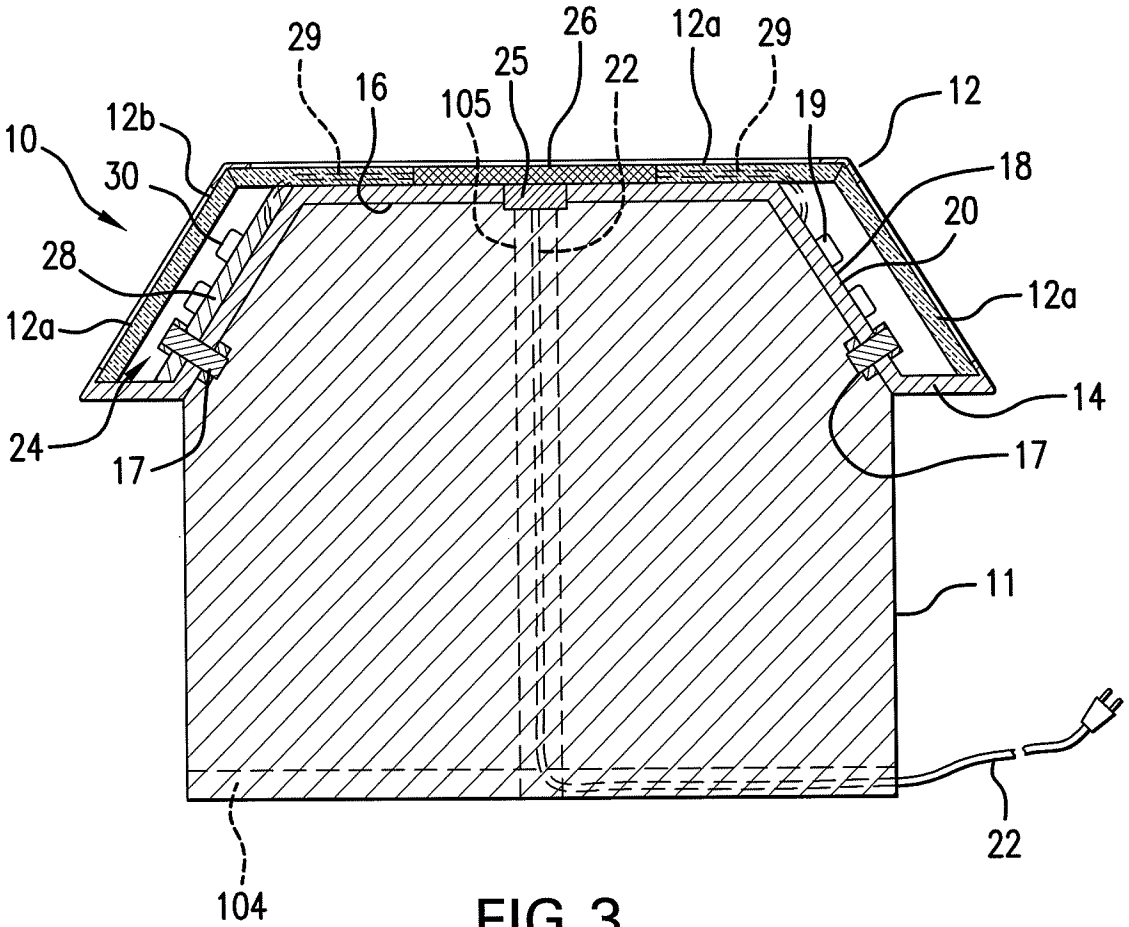
FIG. 3 is a cross-sectional view of the curb barrier of FIG. 2.

The invention herein includes a curb barrier having a lighting source and a lighting source for a curb barrier. The curb barrier may be pre-manufactured to include an upper portion with a lighting source positioned thereon as an assembly readily available to be installed or can be assembled by installing a lighting source according to the invention on a curb barrier such as those in FIGS. 1A or 1B to form an assembly according to the invention. As shown in FIG. 2, the invention includes an illuminated parking barrier to address the problems known in the art. An illuminated parking curb barrier according to one embodiment herein, generally referred to as curb barrier 10 having a curb barrier body 11 is shown in FIGS. 2-3. The barrier helps prevent tripping and injury and is specially designed to include a light source that may be readily installed on existing curb barriers or pre-assembled in newly manufactured curb barriers. Pedestrians and drivers alike can readily see the curb barriers thus illuminated when walking across or driving in a darkened parking lot.

The curb barriers herein include an elongated light source 12 specially configured to be mounted to an existing or newly manufactured parking curb barrier. Most such curb barriers in the prior art and the curb barrier body 11 herein measure several feet in length (approximately about three to about six feet in length), but can vary in length, and up to several inches (approximately 3 to about 4 or 5 inches or more) in height which can also vary depending on the manufacturer of the underlying curb barrier body. The curb barriers 10 herein include lighting source 12 having a shatterproof housing 14 that may be a solid housing formed of translucent material or a frame structure as shown in FIGS. 2 and 3 with panels 12*a* of translucent material. As shown, panels 12*a* are situated in an opening 12*b* in the housing 14 sized to receive corresponding panels 12*a* therein. The panels may be fitted into the housing 14 either through sliding into grooves (not shown) that may be pre-formed in the housing to receive the panels, or can be affixed to the housing 14 at such openings 12*b* by various affixation methods. For example, the panels 12*a* may be glued to an outer or, preferably, an inner surface of the housing 14 near the openings 12*b* so that that panels extend across the openings around the outer periphery of the housing. An optional panel as shown may also be included on the upper portion of the housing extending along the upper surface. Alternatively, the upper surface can be solid housing material. Depending on how much lighting is desired, more or less panels may be used.

Suitable materials for forming the housing 14 preferably includes a material that is resistant to physical damage and durable as well as weather-resistant, for example, metals or metal alloys, which may be coated to prevent rusting, for example, but not limited to, stainless steel, anodized or standard aluminum alloy, nickel or nickel alloys, titanium or titanium alloys, coated iron, and the like with stainless steel or aluminum alloy preferred. Coatings such as weather resistant alloy powder coating, rust-proof paint, or chrome finishes may be provided as well for weather-proofing, water-proofing or aesthetic appearance. However, plastics, hard rubber and composite materials such as fiber- or filler-reinforced thermoplastics or other polymeric materials are acceptable as well. Examples of such materials include, but are not limited to, polystyrene-butadiene-styrenes (SBS), polyacrylonitrile-butadiene-styrenes (ABS), polyamides (PA), polyimides (PI), polyarylenes (polyetherether ketone (PEEK), polyether ketone (PEK), polyether ketone ketone (PEKK) and the like), polyethylene sulfones (PES), polyetherimides (PEI), polytetrafluoroethylene (PTFE), moldable fluoroplastics (FEP and PFA), olefinic rubbers, polyethylenes (PE), polypropylenes (PP), polyoxyalkylenes (i.e., polyacetals) such as polyoxymethylenes (POM), polyoxyethylenes (POE), polyoxybutylenes (POB), etc., styrene-maleic-anhydrides (SMA), polyphenylene sulfides (PPS), polyphenylene oxides (PPO) and other similar molding materials, composites, blends and/or copolymers of these materials, and other materials provided the materials provide adequate strength and preferably nice surface qualities for functioning as a housing in an area which may be fully or partially outdoor, is subject to environmental contaminants, including automotive exhaust and suitable to withstand force. If a composite or polymer is used, the body is preferably comprises PE, PP, ABS, PPS, PPO, PA.

Where translucent material is used either for the entire housing or for panels inserted within a housing that may be non-translucent (whether such panels are located only along the peripheral side(s) or also along the upper surface), preferably a glass, thermoplastic or composite material may be used which is able to transmit light as is known in the art or to be developed. Thermoplastics and composites such as those noted above, if capable of passing light may be used. Such materials are readily available in manufactured sheet that can be easily cut, pressed or molded directly for manufacture into panels of appropriate size. Such materials should allow passage of light from the light source through the panel to the exterior and minimize blockage of light intensity to the extent possible. They are also preferably sufficiently resilient to withstand heavy load damage to the extent possible particularly weight from a human being walking on the barrier or placing a shopping cart of other heavy object on the barrier. It is unlikely they will be able to resist all forces but can be made so as to be replaceable. As protection and strength are desired, high-strength composite materials such as clear polycarbonate or Lucite may be used as well as thick glass or shatterproof glass.

The panels can also be designed so as to be pre-molded to include a company logo or name 13 as shown in FIG. 2. Such logos or names can also be provided by decals or other labels as are known in the art which may be placed on the interior or exterior of the panels.

If panels are used, for further weather-proofing, optional seals or gaskets may be located between the panel and the housing in the border areas where they meet to make the juncture water-tight. Similarly, optional gasketing materials may also be placed around the lower edge of the housing 14 to seat against the underlying curb body 11.

The housing 14 can be mounted to the curb barrier 10 to any of the upper surfaces 16. The housing may be mounted using existing mounting holes (as shown in FIGS. 1A or 1B) or by fasteners 17 located at other locations along the housing. For example, some curb barriers have a single generally flat upper surface 102 as in FIG. 1A, but many of them have a generally flat upper surface 103 having surfaces angled downwardly as shown in FIG. 1B. A housing such as housing 14 could be mounted to either of such types of upper surfaces 102, 103. As shown in FIG. 2 and FIG. 3, the housing 14 is mounted to upper surface 16, which is sloped as in FIG. 1B.

The housing can be mounted by any suitable fastener, for example, a rivet, screw, bolt, cement screw, latch, snap fit connector, a hook and latch mechanism or other fasteners known in the art or to be developed suitable for permanently or releasably attaching a structure to concrete. In a preferred embodiment a bolt and screw configuration is used to mount the housing. In another embodiment, existing bolts may be positioned so as to extend through the housing and down through standard mounting holes such as holes 105 in FIGS. 1A and 1B in a traditional curb barrier.

The light source 12 incorporates a light 18 to provide illumination within the light source 12, for example light bulbs, fiber optics, or a light emitting diodes (LED). Preferably, LED lights 19 are provided, as it is filament-free and more durable. LED lights 19 can be provided on support 20 as shown in FIG. 3. They are preferred in that they remain cool to the touch even after hours of use. They are also environmentally friendly and less expensive to power. However, other suitable and durable lighting, including encased filament lights may be used.

The light source 12, preferably also has a power source 20. The power source may may be or include an optional electrical cable 22 in communication with an electrical current source, preferably a standard AC source, such as a standard 120 V plug. Wiring to a light source can be powered through a wire 22 in electrical communication with a resister or other connection to the light circuit. In one embodiment, wiring 22 can extend through standard holes 105 and exit the barrier through the bottom in a standard groove 104. The wire can also simply extend along the outside of the barrier. The power source 20 preferably includes either in addition to an electrical source or instead thereof, a solar source 24 within the scope of the invention, and it is preferred a solar source be used as in most cases as no additional electrical source is required and it works easily outdoors by deriving energy from the sun. If using solar panels as a power source, the solar photoresister panels 26 can be configured so as to connect to a parabolic collector as is known in the art.

The light source 12 in housing 14 preferably includes power source 20, such as a solar source in the form of photoresisters or panels 26 on a portion of the housing 14 wherein it is most likely to receive solar energy, for example, on the top of the housing 14. The photoresisters may also be located on other locations on the housing or remote, but in electrical connection with the light source. For example, a separate pole having a wire running therethrough connected to a photoresister panel mounted on an upwarding extending pole or a wall can also be used. At least one, and preferably only one battery, such as a AA nickel-cadmium (Nicad) battery 25, as well as a small controller board 28, an LED light source 30 or similar light source, and a photoresister 26 for detecting light level so that the solar light source 30 is activated with the onset of darkness. Such housing 14 and light source 12 are preferably incorporated in the curb barrier 10 herein in one embodiment. The solar panels 24 as a power source is a standard system and the curb barrier 10 can be configured so as to use standard such systems as is well known in the art of use of outdoor solar lighting.

As solar energy contacts the photoresister panel(s) 26, energy is communicated to and stored in battery 25. The panel(s) are wired through a wire 29 in electrical contact from the panel/battery to the LED light source 30 to power LED lights 19.

A single solar cell including a photoresister preferably produces up to about 0.45 V and a varying amount of current depending on cell size and the available amount of solar energy impacting the panel. In the curb barrier 10, therefore, about two to six cells can be used, preferably about three to five cells, more preferably about four or five cells, and most preferably about 4 cells are wired in series on the housing as shown in FIG. 2. Four such cells can provide about 1.8 V and a maximum of about 100 mA when situated in full, bright sunlight.

If solar cells having photoresister panels 26 are used, they are preferably wired directly to a battery 25 through, the LED diode (to prevent the battery's current from flowing back through the solar cell(s) at night). The battery can be of a variety of sizes, but for solar cells of the type noted above, a standard AA Nicad battery is preferred. Such a battery is about to produce about 1.2 V and to store up to about 700 mA-hr. During the day, the battery charges, reaching maximum charge except on shorter days or on heavily overcast days. At night, solar cells stop producing power. At night, the photoresister activates the LED or other light source. The controller board 28 accepts power from the cell panels(s) 26 and the battery 25. In areas where there is inadequate sunlight or significantly overcast weather, an optional power cord as shown in FIG. 3 may be included, wherein the operator of the parking area, if sufficient light and power are not derived from the solar panels 26, then back-up electrical power can be invoked. The plug may be a weather-resistant plug (or having a weather-resistant cap) or be capable of being stored in a groove under the curb barrier.

The curb barrier herein may include, for example, a three transistor circuit to activate the LED when the photoresistor solar panel 26 indicates darkness or reduced lighting. At that point, the light source is activated and the curb barrier illuminated when it is dark.

The illuminated curb barriers herein provide benefits and advantages over the prior art including providing a simple way to illuminate a parking barrier during night and low-light times of day (e.g., dawn and dusk) ensuring enhanced visibility for the curb barrier. Installed on any existing curb barrier or incorporated into a newly manufactured parking curb barrier, the invention provides a powerful light source that enables pedestrians or drivers to easily discern the barrier's position, giving them time and the ability to navigate around the barrier. Painful injuries as well as damage to vehicles is thus avoided. Liability for injury or damage to property to property owners is also avoided. The lights can also contribute to a well-lit area that can help to deter crime by making things more difficult for thieves or criminals who seek darkness to commit crimes. If equipped with solar cells, the illuminated curb barriers are also economical and environmentally friendly.

The illuminated curb barriers herein enable pedestrians to safely walk across a parking lot at night and for drivers to ensure they do not inadvertently drive into or onto a parking curb barrier. Illuminating the parking curb barrier with a brilliant beacon of solar powered light, can contribute greatly to parking lot safety.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An illuminated curb barrier, comprising:

a curb barrier body having a flat upper surface perpendicular to generally rectangular or generally square side surfaces of the curb body; and a lighting source configured to be situated over the upper surface of the curb barrier body so as to provide lighting along at least a peripheral area of the curb barrier body, wherein the illuminated lighting source further comprises a power source and a housing mounted to the curb barrier body and a light within the housing for providing illumination.

2. The illuminated curb barrier according to claim 1, wherein the curb barrier housing has at least one upper surface and the lighting source is further situated so as to provide light through the upper surface of the curb barrier housing.

3. The illuminated curb barrier according to claim 1, wherein the housing is mounted to the curb barrier using at least one screw.

4. The illuminated curb barrier according to claim 1, wherein the power source is a solar source.

5. The illuminated curb barrier according to claim 4, wherein the solar source comprises at least one solar photoresister panel situated on the housing, a battery in electrical communication with the panel, a controller board, and an LED light source.

6. The illuminated curb barrier according to claim 5, wherein the battery is a nickel cadmium battery.

7. The illuminated curb barrier according to claim 6, further comprising situating a diode of the LED between a battery and the at least one solar cell.

8. The illuminated curb barrier according to claim 7, comprising about four to about six solar cells.

9. The illuminated curb barrier according to claim 5, wherein the power source comprises an electrical power source.

10. An illuminated housing for use on a curb barrier according to claim 1, the housing comprising a power source and lighting source, wherein the lighting source is situated within the housing and the housing is configured for placement on an upper surface of a curb barrier.

11. The illuminated housing for a curb barrier according to claim 10, wherein the power source is a solar source, and the solar source comprises at least one solar photoresister panel situated on an upper surface of the housing, a battery, a controller board, and an LED light source.

12. The illuminated housing for a curb barrier according to claim 1, wherein the flat upper surface is perpendicular to generally rectangular or generally square side surfaces of the curb body.

13. The illuminated housing for a curb barrier according to claim 1, wherein the flat upper surface has tapered edges meeting generally square or generally rectangular side surfaces of the curb body.

* * * * *